US010396491B2

(12) United States Patent
Hsu

(10) Patent No.: US 10,396,491 B2
(45) Date of Patent: Aug. 27, 2019

(54) ALIGNMENT STRUCTURES FOR CHIP MODULES

(71) Applicant: FOXCONN INTERCONNECT TECHNOLOGY LIMITED, Grand Cayman (KY)

(72) Inventor: Shuo-Hsiu Hsu, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/846,126

(22) Filed: Dec. 18, 2017

(65) Prior Publication Data

US 2018/0175548 A1 Jun. 21, 2018

(30) Foreign Application Priority Data

Dec. 16, 2016 (CN) ..... 2016 2 1382682 U

(51) Int. Cl.

| | |
|---|---|
| ***H01R 11/30*** | (2006.01) |
| ***H01R 13/62*** | (2006.01) |
| *H01R 12/73* | (2011.01) |
| *H01R 13/64* | (2006.01) |
| *H01R 31/06* | (2006.01) |
| *H01R 105/00* | (2006.01) |
| *H01R 13/22* | (2006.01) |

(52) U.S. Cl.

CPC ..... *H01R 13/6205* (2013.01); *H01R 12/732* (2013.01); *H01R 13/22* (2013.01); *H01R 13/64* (2013.01); *H01R 31/06* (2013.01); *H01R 2105/00* (2013.01)

(58) Field of Classification Search

CPC ..... H01R 13/6205; H01R 13/6658; H01R 23/7073

USPC ..... 439/38, 39, 76.1, 660

See application file for complete search history.

(56) References Cited

U.S. PATENT DOCUMENTS

| | | | | |
|---|---|---|---|---|
| 6,736,680 | B2 * | 5/2004 | Slack | H01R 13/6658 439/620.26 |
| 7,517,231 | B2 * | 4/2009 | Hiew | H05K 9/0067 439/76.1 |
| 7,530,818 | B1 * | 5/2009 | Wang | H01R 31/065 439/638 |
| 7,637,784 | B2 * | 12/2009 | Evans | H01R 31/065 439/638 |
| 7,798,853 | B2 * | 9/2010 | Shi | H01R 13/6658 439/607.58 |

(Continued)

*Primary Examiner* — Thanh Tam T Le

(74) *Attorney, Agent, or Firm* — Wei Te Chung; Ming Chieh Chang

(57) ABSTRACT

A coupling system includes a first connecting unit and a second connecting unit adapted to be connected to each other either directly or indirectly through an adaptor. Each of the first connecting unit and a second connecting unit includes an enclosure with a first mating surface and a second mating face perpendicular to each other, a pair of chip modules and an electrical connector. The electrical connector is exposed on the first mating surface while the chip module is protectively hidden behind the second mating surface. The electrical connector is equipped with magnets for activating mating with a counterpart electrical connector so as to have the chip modules of the first connecting unit and those of the second connecting unit aligned for coupling.

14 Claims, 10 Drawing Sheets

(56) References Cited

U.S. PATENT DOCUMENTS

| | | | | |
|---|---|---|---|---|
| 7,872,871 | B2 * | 1/2011 | Hiew | G06F 1/1632<br>361/730 |
| 7,993,157 | B2 * | 8/2011 | Azizi-Namini | H01R 9/03<br>439/469 |
| 8,444,423 | B2 * | 5/2013 | Nguyen | H01R 13/6658<br>439/76.1 |
| 8,657,031 | B2 * | 2/2014 | Kononenko | B25F 5/00<br>173/176 |
| 8,794,980 | B2 * | 8/2014 | McCormack | H01R 13/6205<br>439/39 |
| 9,190,772 | B2 * | 11/2015 | Wang | H01R 13/6205 |
| 2003/0211782 | A1 * | 11/2003 | Esparaz | H01R 13/6658<br>439/620.11 |
| 2004/0014361 | A1 * | 1/2004 | Slack | H01R 13/6658<br>439/620.11 |
| 2013/0157477 | A1 | 6/2013 | Keyssa | |

* cited by examiner

ALIGNMENT STRUCTURES FOR CHIP MODULES

FIELD OF THE DISCLOSURE

The invention is related to an optical and electrical connector assembly used in a coupling system, and particularly to the connector equipped with the magnet structures for precise alignment therebetween. The instant application relates to the copending application having the same applicant, the same filing date and a title of "LENS SURROUNDED BY MAGNET".

DESCRIPTION OF RELATED ARTS

The existing high frequency microwave chip may perform high speed signal transmission. Anyhow, it is required to have the two corresponding chips coupled precisely for eliminating the transmission loss. At the same time, it is also required to have the lens associated with the chip for optical signal transmission. The traditional connection is to use a pair of connectors, of which one has a protruding structure and the other has a recessed structure receiving such a protruding structure therein for aligning and retaining the coupled connector together. Anyhow, such arrangement may fit for the traditional heavy duty style while not for the modern type requiring the smooth interface and gentle treatment.

It is desired to provide a connector assembly for both electrical and optical transmission thereof with an easy and precise coupling device thereof.

SUMMARY OF THE DISCLOSURE

To achieve the above desire, a new coupling system is provided with two mutually perpendicular interfaces wherein a first interface equipped with magnets is the active one to actuate the second one aligned precisely for efficient signal transmission. The coupling system includes a first connecting unit and a second connecting unit adapted to be connected to each other either directly or indirectly through an adaptor. Each of the first connecting unit and a second connecting unit includes an enclosure with a first mating surface and a second mating face perpendicular to each other, a pair of chip modules and an electrical connector. The electrical connector is exposed on the first mating surface while the chip module is protectively hidden behind the second mating surface. A printed circuit board assembly is disposed in the enclosure, on which both the electrical connector and the chip modules are mounted. The electrical connector is equipped with magnets for activating mating with a counterpart electrical connector. An absorption device is located between the pair of chip modules. The second mating surface of the first connecting unit and that of the second connecting unit are configured to be intimately and smoothly moveable with each other along a horizontal interfacial plane until the mating between the first mating surfaces is complete.

DETAILED DESCRIPTION OF THE PREFERRED EMBODIMENT

Figure 1:
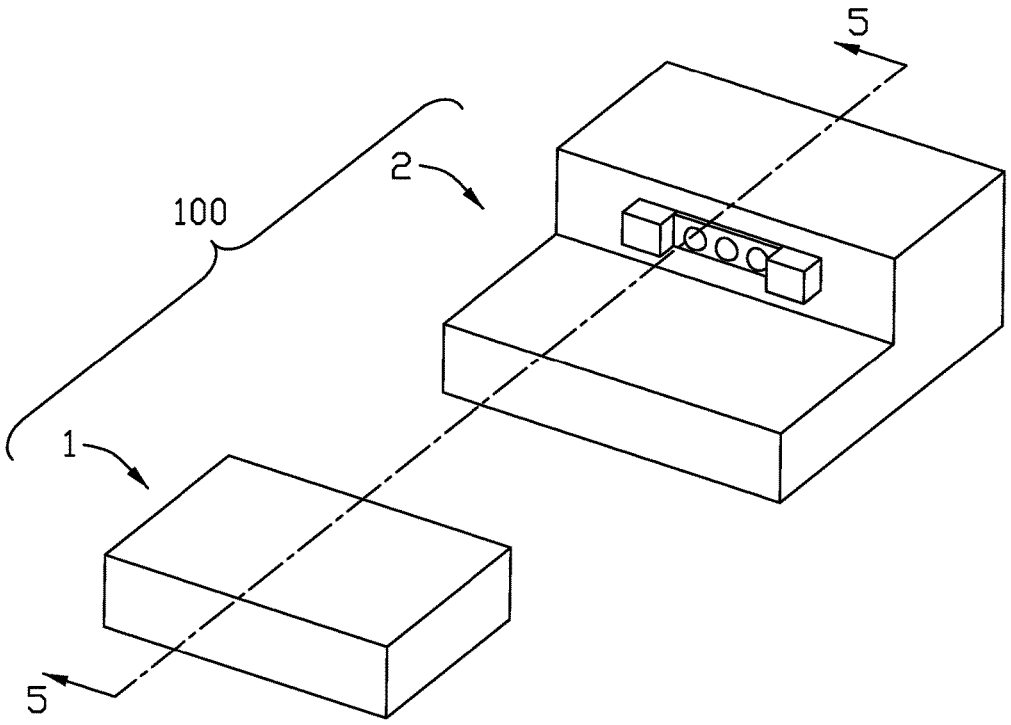
FIG. 1 is a perspective view of the coupling system according to a first embodiment of the invention.
Figure 2:
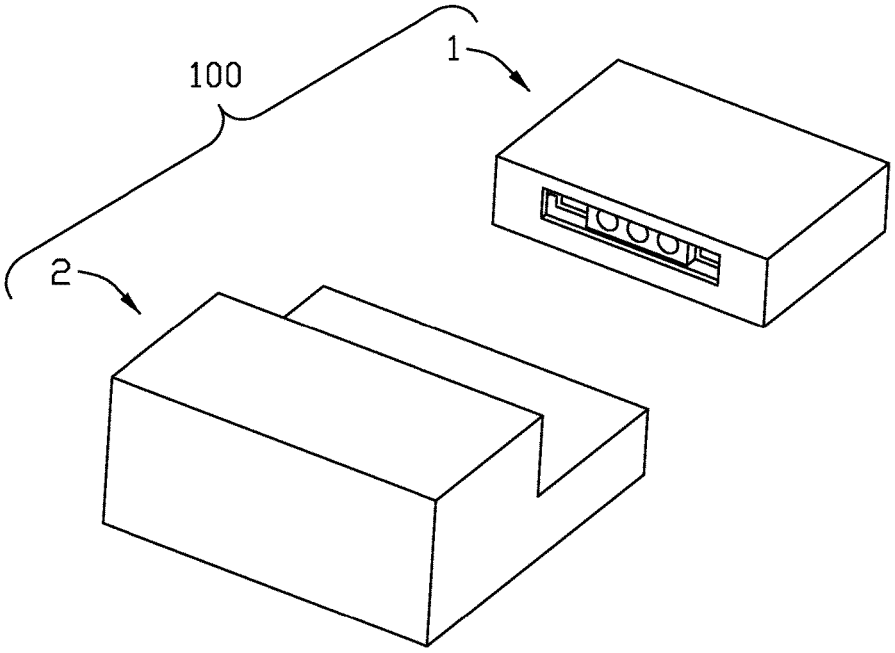
FIG. 2 is another perspective view of the coupling system of FIG. 1.
Figure 3:
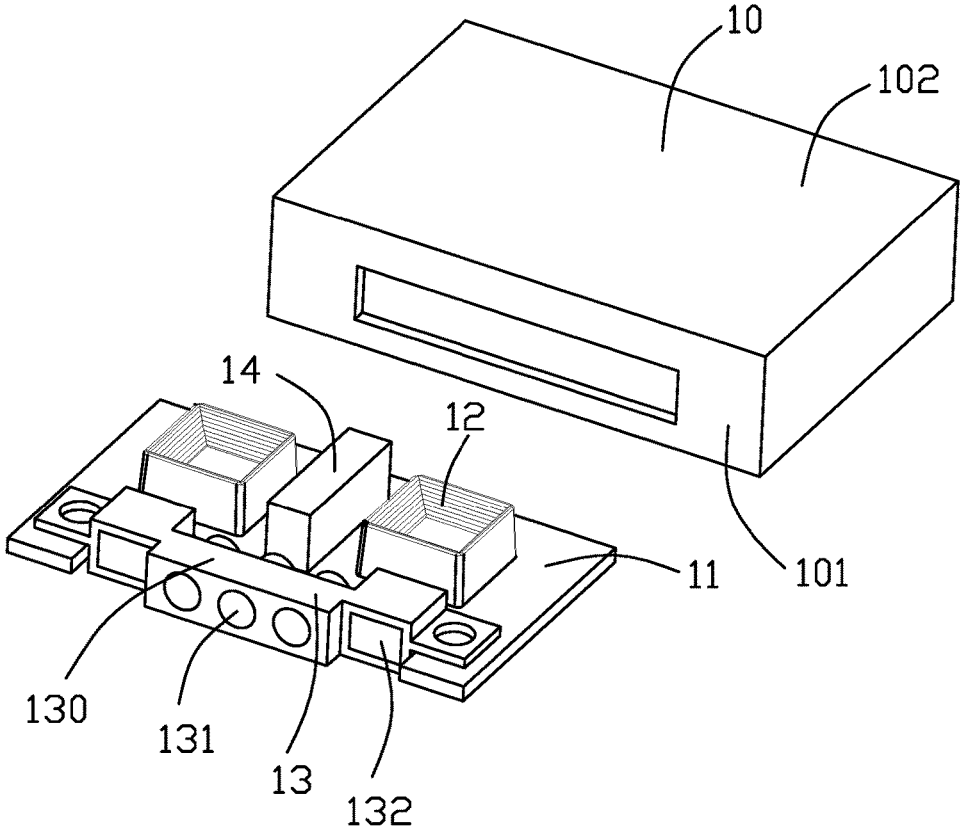
FIG. 3 is an exploded perspective view of the first connecting unit of the coupling system of FIG. 1.
Figure 4:
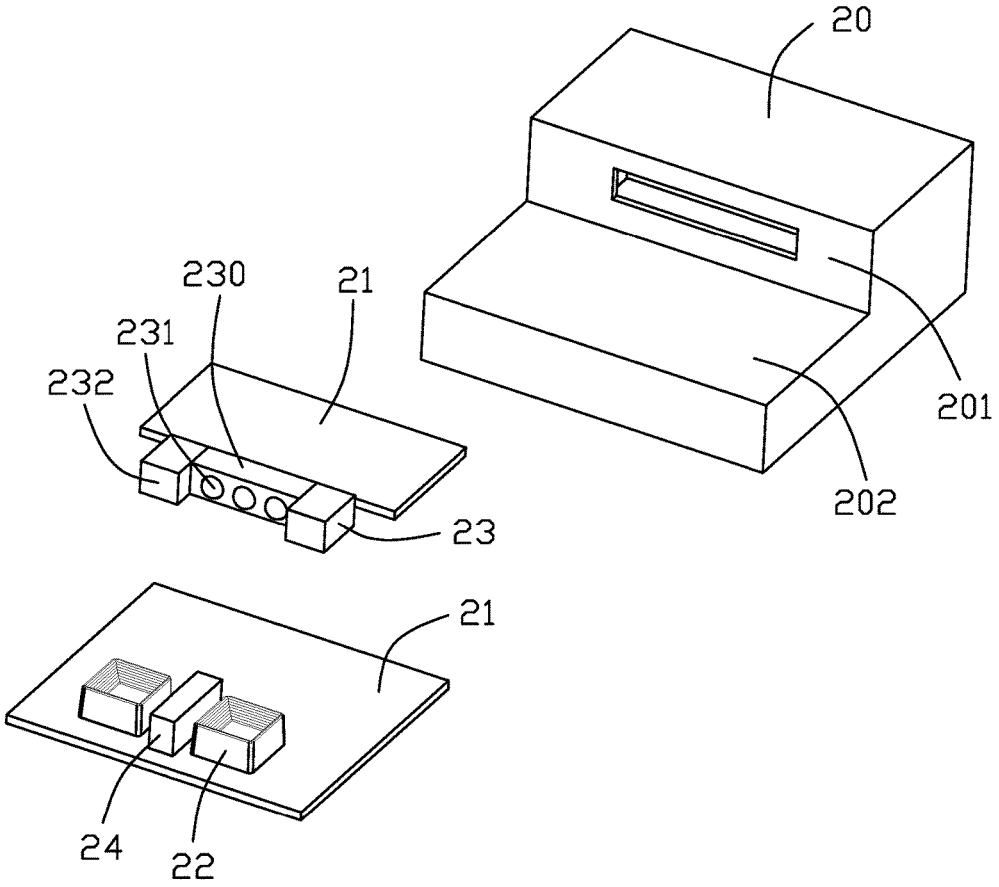
FIG. 4 is an exploded perspective view of the second connecting unit of the coupling system of FIG. 1.
Figure 5:
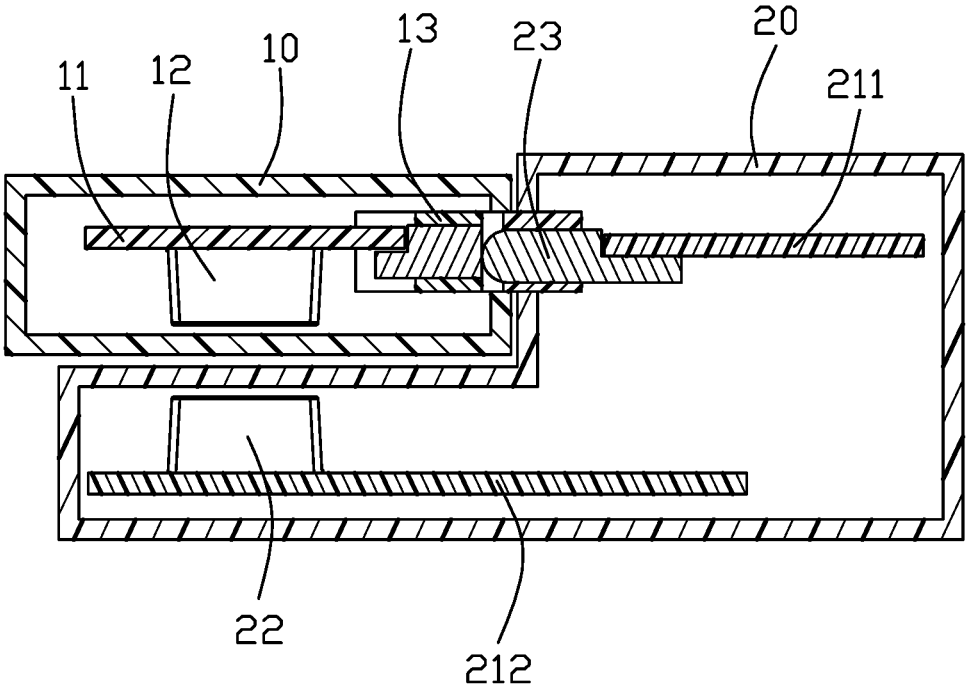
FIG. 5 is a cross-sectional view of the coupling system of FIG. 1.
Figure 6:
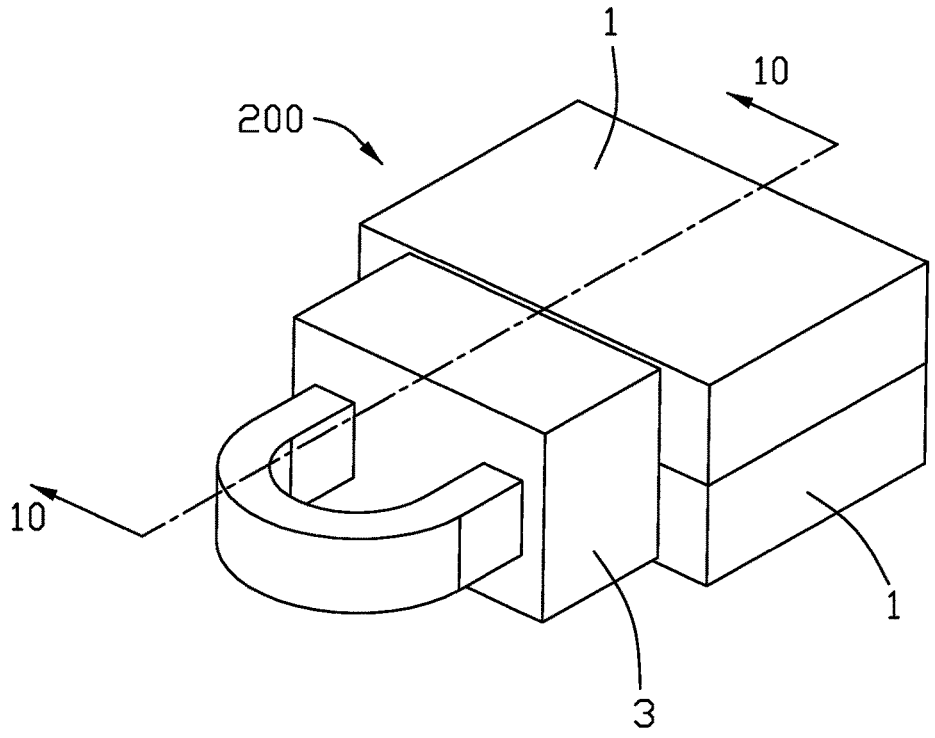
FIG. 6 is a perspective view of the coupling system according to a second embodiment of the invention.
Figure 7:
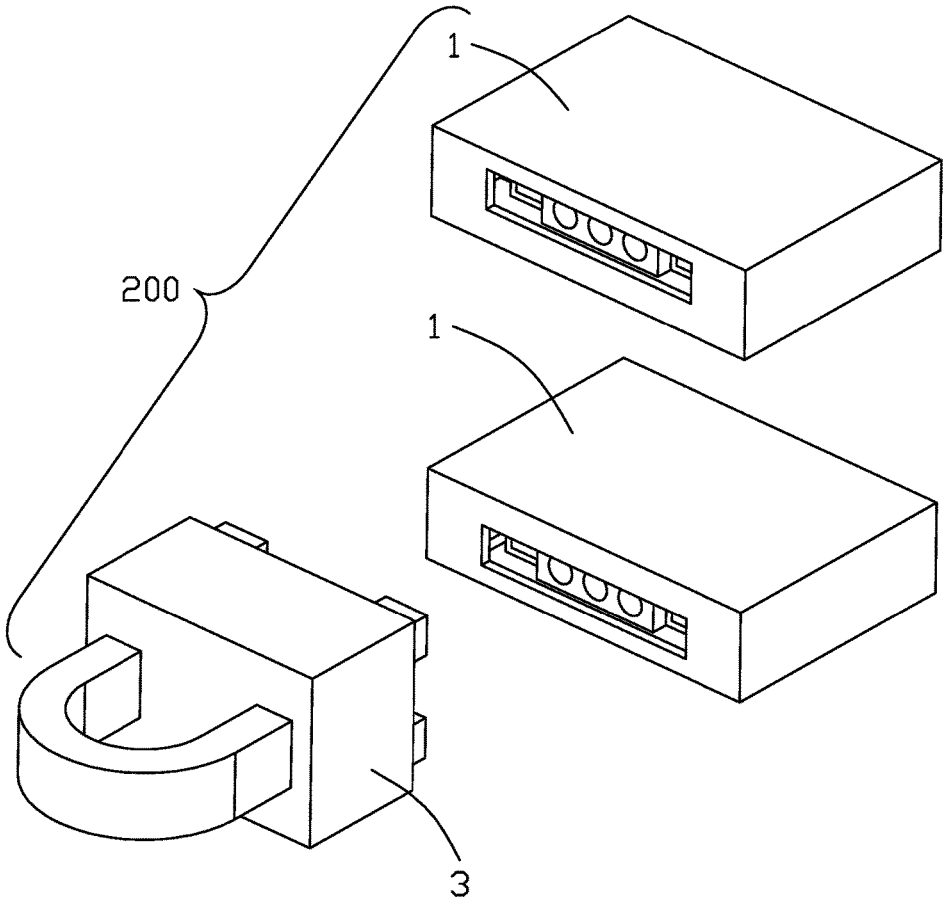
FIG. 7 is an exploded perspective view of the coupling system of FIG. 6.
Figure 8:
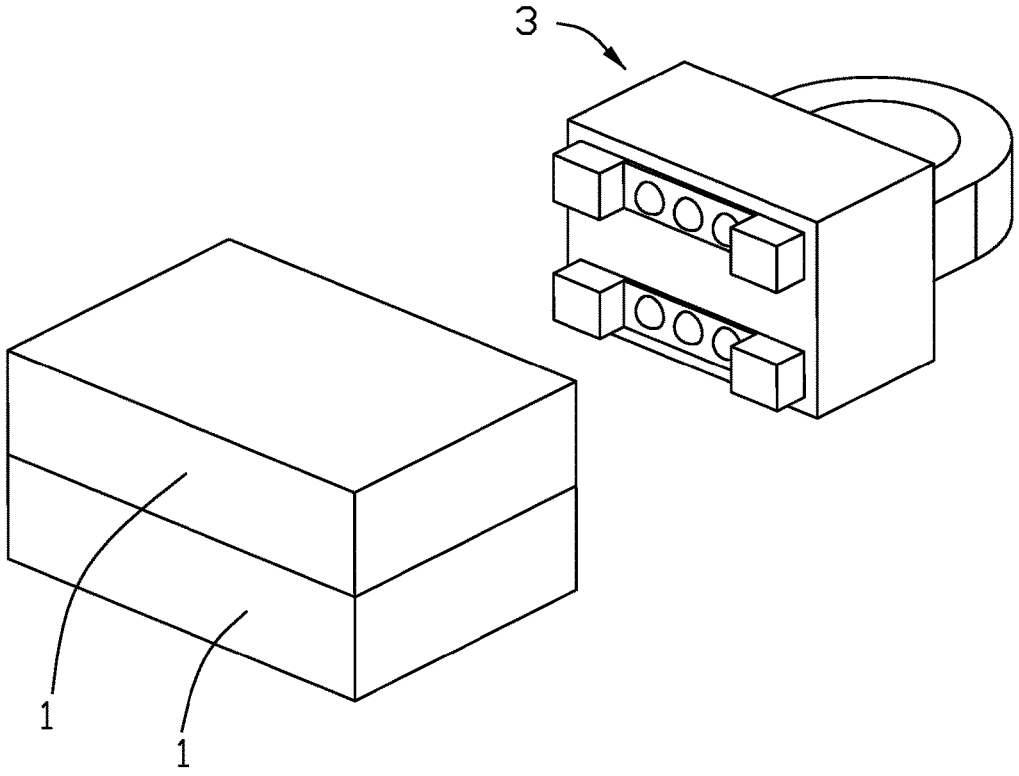
FIG. 8 is another exploded perspective view of the coupling system of FIG. 6

Reference will now be made in detail to the embodiments of the present disclosure. Referring to FIGS. 1-5, A coupling system 100 includes a first connecting unit 1 and a second connecting unit 2 used on the electronic devices for signal transmission therebetween.

The first connecting unit 1 includes an insulative enclosure 10 and a printed circuit board 11 received within the enclosure 10. The enclosure forms a first mating surface 101 and an even/smooth mating surface 102 perpendicular to each other. A pair of chip modules 12, an electrical connector 13 and an absorption device 14 are mounted upon the printed circuit board 11. The chip module 12 is directed to the second mating surface 102 in a hidden manner for the high speed signal transmission as mentioned in U.S. Pat. No. 8,909,135. The chip modules 12 function for transmission and receiving, respectively. An absorption device 14 is located between the pair of chip modules 12 for filtering noises derived from the chip modules 12.

The electrical connector 13 is located upon an edge of the printed circuit board 11 and exposed upon the first mating surface 101. The electrical connector 13 is of a magnetic attraction type for electrical transmission, and includes an insulative housing 130 with a plurality of contacts 131 and a pair of magnetic elements 132 therein. In this embodiment, the contact 131 are not resilient or moveable, and the pair of magnetic elements 132 located on two opposite sides are magnets. Anyhow, in other embodiments, the magnetic element 132 may be magnetic attraction element or electromagnet etc., alone or in combination.

The second connecting unit 2 includes an insulative enclosure 20 and a printed circuit board assembly 21 disposed in the insulative enclosure 20. The insulative enclosure 20 includes a first mating face 201 and the second mating face 202 perpendicular to each other. The printed circuit board assembly 21 includes a first printed circuit board 211 and the second printed circuit board 212 electrically connected with each other. An electrical connector 23 is located upon an edge of the first printed circuit board 211 and exposed upon the first mating face 201 while a pair of chip modules 22 and an absorption device 24 therebetween are located upon the second printed circuit board 212 and are located within the enclosure 20 and hidden under the second mating face 202. The functions of the pair of chip modules 22 are same with those of the pair of chip modules 12. The function of the absorption device 24 is same with the absorption device 14. Notably, the enclosure 20 of the second connecting unit 2 forms a recessed structure in which the first connecting unit 1 is disposed.

Similar to the electrical connector 13, the electrical connector 23 is of a magnetic attraction type for electrical transmission, and includes an insulative housing 230, and a plurality of contacts 231 and the pair of magnetic elements 232 commonly located therein, wherein the pair of magnetic elements 232 are located by two sides of the contacts 231. The contacts 231 are of the pogo pin type, Similar to the magnetic elements 132, the pair of magnetic elements 232 may be the magnets, the magnetic attraction elements or the electromagnets, etc., alone or in combination.

When the first connecting unit 1 and the second connecting unit 2 are coupled with each other, the first mating surface 101 of the first connecting unit 1 and the first mating face 201 of the second connecting unit 2 are mated with each other while the second mating surface 102 of the first connecting unit 1 and the second mating face 202 of the second mating face 202 of the second connecting unit 2 are intimately contacting and sliding with each other. Once the electrical connector 13 of the first connecting unit land the electrical connector 23 of the second connecting unit 2 are fully mated with each other via magnetic attraction derived from the pair of magnetic elements 132 and the pair of magnetic elements 232, the first mating surface 101 of the first connecting unit 1 and the first mating face 201 of the second connecting unit 2 are correctly positioned with each other, and the second mating surface 102 of the first connecting unit 1 and the second mating face 202 of the second connecting unit 2 are also correspondingly positioned with each other in an intimate sliding manner. Therefore, the chip modules 12 of the first connecting unit 1 and the chip modules 22 of the second connecting unit 2 are aligned with each other precisely, thus assuring the perfect transmission/receiving between the chip modules 12 of the first connecting unit 1 and the chip modules 22 of the second connecting unit 2.

Referring to FIGS. 6-10, a coupling system 200 includes a pair of connecting units 1 commonly mated with an adaptor unit 3 on one same side thereof. Notably, the two connecting units 1 in the second embodiment are essentially same with the connecting unit 1 in the first embodiment so no further detailed description is required.

Figure 9:
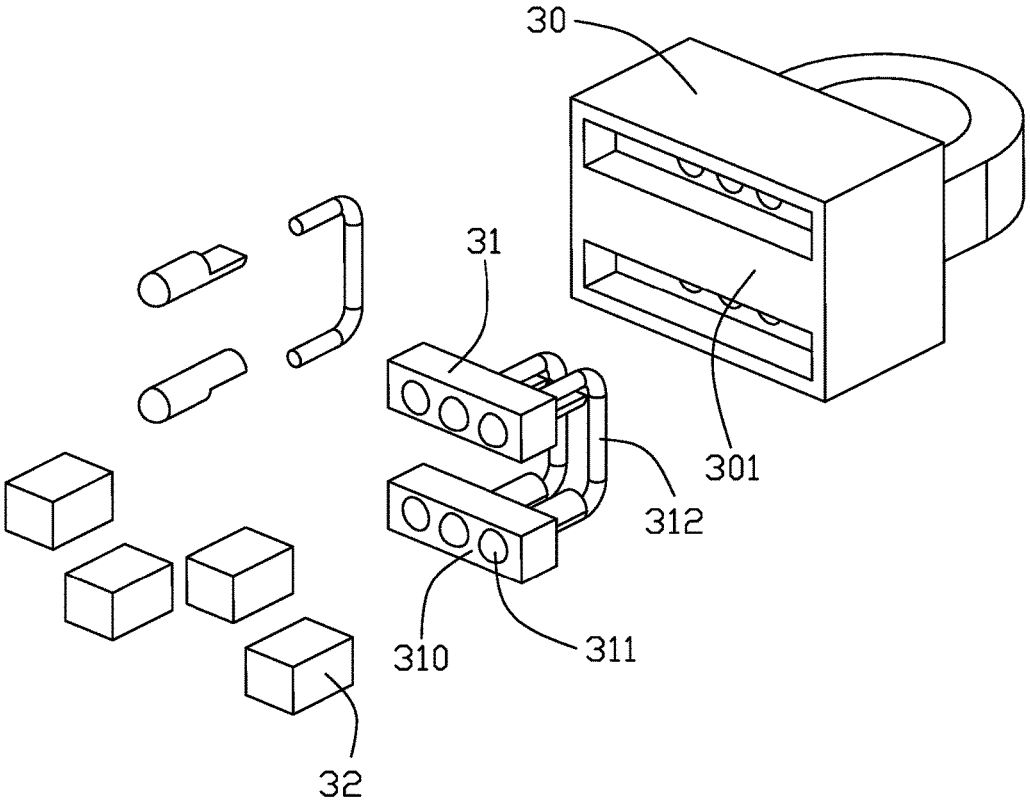
FIG. 9 is an exploded perspective view of the adaptor of the coupling system of FIG. 6

As shown in FIG. 9, the adaptor unit 3 includes an insulative enclosure 30 and a pair of electrical connectors 31. The insulative enclosure 30 forms a mating face 301 for mating with the first mating surfaces 101 of the two connecting units 1. The pair of electrical connectors 31 are exposed upon the mating face and simultaneously mating with the corresponding connectors 13 of the connecting units 1. The electrical connectors 31 are same and similar to the electrical connector 23, each including an insulative housing 310, a plurality of contacts 311 and a pair of magnetic elements 32 by two sides of the contacts 311 and commonly within the insulative housing 310. A plurality of U-shaped contacts 312 respectively link the contacts 311 of the pair of electrical connectors 31.

Figure 10:
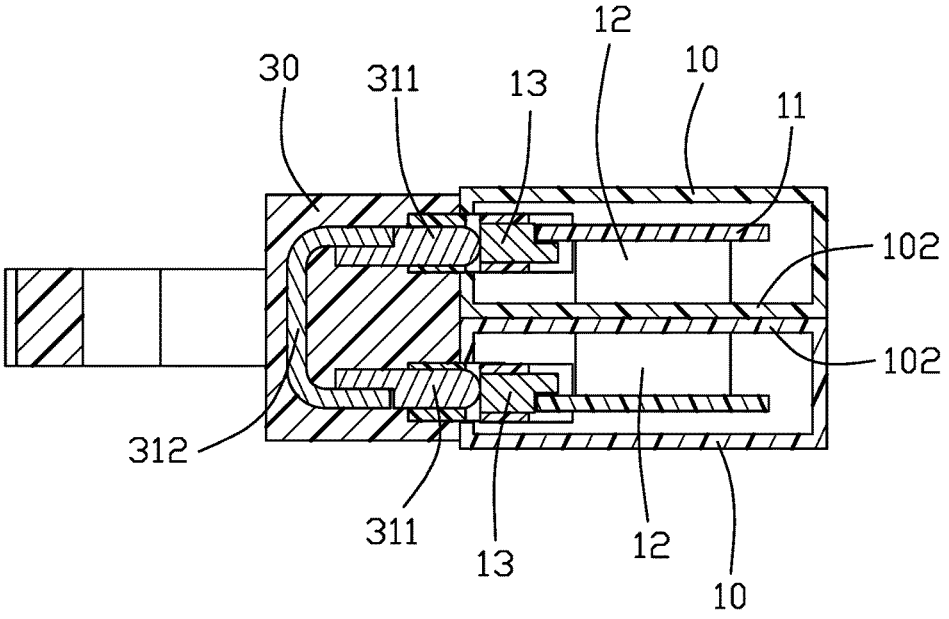
FIG. 10 is a cross-sectional view of the coupling system of FIG. 6.

As shown in FIG. 10, during mating, the adaptor unit 3 is mated with both two connecting units 1 wherein the first mating surfaces 101 of the two connecting units 1 are mated with the same mating face 301 of the 3 adaptor unit 3 so as to be in a same vertical plane, thus assuring the chip modules 13 behind the second mating surfaces 102 of the two connecting units 1 are aligned with each other in the vertical direction. Therefore, a perfect extremely high speed transmission is obtained.

While a preferred embodiment according to the present disclosure has been shown and described, equivalent modifications and changes known to persons skilled in the art according to the spirit of the present disclosure are considered within the scope of the present disclosure as described in the appended claims.

What is claimed is:

1. A coupling system comprising:

a first connecting unit including:

an insulative enclosure defining a first mating surface and a second mating surface perpendicular to each other;

a printed circuit board received within the enclosure;

an electrical connector mounted upon the printed circuit board and operationally exposed upon the first mating surface;

a pair of chip modules for extremely high speed communication mounted upon the printed circuit board and operationally facing toward the second mating surface in a hidden manner; and a second connecting unit, wherein said second connecting unit includes another enclosure with a printed circuit board assembly received within said another enclosure, and defines a first mating face intimately confronting the first mating surface, and a second mating face perpendicular to the first mating face and intimately confronting the second mating surface;

wherein the electrical connector is equipped with magnetic elements; and wherein one of the electrical connectors of the first connecting unit and the second connecting unit is of a pogo type and the other is of a stationary type.

2. The coupling system as claimed in claim 1, wherein the second connecting unit further includes another pair of chip modules mounted upon the printed circuit board assembly behind the second mating face for extremely high speed transmission and coupling to the pair of chip modules of the first connecting unit, and another electrical connector for mating with the electrical connector of the first connecting unit.

3. The coupling system as claimed in claim 2, wherein the pair of chip modules of the first connecting unit are aligned with the pair of chip modules of the second connecting unit in a direction perpendicular to both the second mating surface and the second mating face.

4. The coupling system as claimed in claim 2, wherein said another electrical connector is equipped with magnetic elements for magnetic attraction the magnetic elements of the electrical connector of the first connecting unit.

5. The coupling system as claimed in claim 1, wherein said printed circuit board assembly includes two printed circuit boards respectively connected to said another electrical connector and said another pair of chip modules.

6. The coupling system as claimed in claim 1, wherein the enclosure of the second connecting unit forms a recessed structure in which the enclosure of the first connecting unit is received.

7. The coupling system as claimed in claim 1, further including another first connecting unit intimately stacked upon said first connecting unit in an upside-down manner, wherein the second mating surface of said two first connecting units intimately confront each other and the corresponding chip modules of said two first connecting units are aligned with each other in a direction perpendicular to both said two second mating surfaces.

8. The coupling system as claimed in claim 7, further including an adaptor unit, wherein said adaptor unit forms a mating face confronting the first mating surfaces of the two connecting units and equipped with a pair of electrical connectors for mating with the electrical connectors of the two first connecting units so as to have the two first connecting units are aligned with each other in said direction.

9. The coupling system as claimed in claim 8, wherein the electrical connectors of the two connecting units are equipped with magnetic elements, and the pair of electrical connectors of the adaptor unit are equipped with magnetic elements for magnetic attraction with the magnetic elements of the two connecting units in another direction perpendicular to said direction.

10. The coupling system as claimed in claim 8, wherein the two electrical connectors of the adaptor unit are connected with each other.

11. The coupling system as claimed in claim 8, wherein either the electrical connector of the adaptor unit or the electrical connector of the first connecting unit is of a pogo type.

12. A coupling system comprising:

a first connecting unit including:

an insulative enclosure defining a first mating surface and a second mating surface perpendicular to each other;

a printed circuit board received within the enclosure;

magnet elements operated upon the first mating surface;

a pair of chip modules for extremely high speed communication mounted upon the printed circuit board and operationally facing toward the second mating surface in a hidden manner; and a second connecting unit couple with the first connecting unit, wherein said second connecting unit includes another insulative enclosure with a printed circuit board assembly therein, and defines a first mating face intimately confronting the first mating surface, and a second mating face perpendicular to the first mating face and intimately confronting the second mating surface;

wherein the second connecting unit further includes another pair of chip modules mounted upon the printed circuit board assembly and behind the second mating face for extremely high speed transmission and coupling to the pair of chip modules of the first connecting unit, and other magnetic elements intimately confronting the magnetic elements of the first connecting unit for magnetic attraction therebetween; and wherein said another enclosure of the second connecting unit forms a recessed structure in which the enclosure of the first connecting unit is disposed.

13. The coupling system as claimed in claim 12, further including another first connecting unit intimately stacked upon said first connecting unit in an upside-down manner, wherein the second mating surfaces of said two first connecting units intimately confront each other and the corresponding chip modules of said two first connecting units are aligned with each other in a direction perpendicular to both said two second mating surfaces.

14. The coupling system as claimed in claim 13, further including an adaptor unit, wherein said adaptor unit forms a mating face confronting the first mating surfaces of the two connecting units and equipped with other magnetic elements thereon to attract the corresponding magnetic elements of the two first connecting units so as to have the two first connecting units are aligned with each other in said direction.

* * * * *